US009994046B2

(12) United States Patent
Ohara et al.

(10) Patent No.: US 9,994,046 B2
(45) Date of Patent: Jun. 12, 2018

(54) INKJET PRINTING DEVICE AND INKJET PRINTING METHOD

(71) Applicant: MIMAKI ENGINEERING CO., LTD., Nagano (JP)

(72) Inventors: Kazuki Ohara, Nagano (JP); Tomotaka Furuhata, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days. days.

(21) Appl. No.: 15/304,063

(22) PCT Filed: Apr. 8, 2015

(86) PCT No.: PCT/JP2015/060921
§ 371 (c)(1),
(2) Date: Oct. 14, 2016

(87) PCT Pub. No.: WO2015/159765
PCT Pub. Date: Oct. 22, 2015

(65) Prior Publication Data

US 2017/0036459 A1 Feb. 9, 2017

(30) Foreign Application Priority Data

Apr. 16, 2014 (JP) ..... 2014-084914

(51) Int. Cl.
*B41J 11/00* (2006.01)
*B41M 7/00* (2006.01)
*B41J 2/01* (2006.01)

(52) U.S. Cl.
CPC ..... *B41J 11/002* (2013.01); *B41J 2/01* (2013.01); *B41M 7/0081* (2013.01)

(58) Field of Classification Search
CPC ..... B41J 11/002; B41J 11/0015; B41J 2/01; B41J 2/2107; B41J 2/2114; B41J 2/2117
See application file for complete search history.

(56) References Cited

U.S. PATENT DOCUMENTS 9,475,277 B2 * 10/2016 Ohnishi ..... B41J 2/01
2008/0068431 A1 3/2008 Yokoyama
(Continued)

FOREIGN PATENT DOCUMENTS

JP 2005-144679 6/2005
JP 2007112117 5/2007
(Continued)

OTHER PUBLICATIONS

"International Search Report (Form PCT/ISA/210)", dated Jun. 30, 2015, with English translation thereof, pp. 1-4.
(Continued)

*Primary Examiner* — Lamson Nguyen
(74) *Attorney, Agent, or Firm* — JCIPRNET

(57) ABSTRACT

Generation of cockling is suppressed to enable superior image quality printing. An inkjet printing device is provided with a head discharging ultraviolet curing ink onto a medium, pinning irradiation sections irradiating the ultraviolet curing ink on the medium with light, and a curing irradiation section arranged on a downstream side of the pinning irradiation sections in a conveying direction of the medium, and radiating light with a shorter wavelength than the pinning irradiation sections.

8 Claims, 2 Drawing Sheets

(56) References Cited

U.S. PATENT DOCUMENTS

| | | | |
|---|---|---|---|
| 2012/0062668 | A1 | 3/2012 | Caruthers et al. |
| 2015/0251409 | A1 | 9/2015 | Ohnishi |

FOREIGN PATENT DOCUMENTS

| | | |
|---|---|---|
| JP | 2010208148 | 9/2010 |
| JP | 2011-084025 | 4/2011 |
| JP | 2012-011778 | 1/2012 |
| JP | 2012-045908 | 3/2012 |
| JP | 2012126019 | 7/2012 |
| JP | 2013199110 | 10/2013 |
| JP | 2013202937 | 10/2013 |
| JP | 2014-076639 | 5/2014 |
| WO | 2012070470 | 5/2012 |

OTHER PUBLICATIONS

"Search Report of Europe Counterpart Application", dated Apr. 10, 2017, p. 1-p. 9.

"Office Action of Japan Counterpart Application," dated Nov. 7, 2017, with English translation thereof, p. 1-p. 26, in which the listed references were cited.

* cited by examiner

INKJET PRINTING DEVICE AND INKJET PRINTING METHOD

CROSS-REFERENCE TO RELATED APPLICATION

This application is a 371 of international application of PCT application serial no. PCT/JP2015/060921, filed on Apr. 8, 2015, which claims the priority benefit of Japan application no. JP 2014-084914 filed on Apr. 16, 2014. The entirety of each of the above-mentioned patent applications is hereby incorporated by reference herein and made a part of this specification.

TECHNICAL FIELD

The present invention relates to an inkjet printing device and an inkjet printing method.

BACKGROUND ART

In an inkjet printing device, printing is performed by discharging ink onto a recording medium while moving an inkjet head in a reciprocating manner. In an inkjet printing device as above, there are types that perform printing using ultraviolet curing ink (hereinbelow referred to as UV ink) (for example, see Patent Literature 1). The UV ink is ink that is cured when it is irradiated with ultraviolet light.

An inkjet printing device described in Patent Literature 1 is provided with a right ultraviolet irradiation device arranged on a right side of an inkjet head, and a left ultraviolet irradiation device arranged on a left side of the inkjet head. Due to this, ink can be discharged in an outbound motion and be irradiated with ultraviolet light, and the ink can also be discharged in an inbound motion and be irradiated with the ultraviolet light in each reciprocating motion of the inkjet head.

CITATION LIST

Patent Literatures

Patent Literature 1: Japanese Unexamined Patent Publication No. 2005-144679 (published on Jun. 9, 2005)

SUMMARY

Technical Problems

In an inkjet printing device as described in Patent Literature 1, ultraviolet light is radiated from the ultraviolet irradiation device to cure ultraviolet curing ink while the ultraviolet curing ink is discharged onto the recording medium in a concurrent process thereof In this case, the ultraviolet curing ink which has been irradiated with the ultraviolet light exhibits thermal contraction and curing contraction, as a result of which cockling, in which a wrinkle is generated at a portion where the ultraviolet curing ink is discharged and the recording medium ripples thereby, may be generated. If the cockling is generated in this state, problems such as the inkjet head touching the recording medium and image quality deterioration may occur.

Thus, the present invention has been made in view of the above problems, and an aim is to provide an inkjet printing device and an inkjet printing method that can suppress generation of cockling and can perform printing with satisfactory image quality.

Solutions to the Problems

To achieve the above aim, an inkjet printing device according to an embodiment of the present invention includes a head configured to discharge ink, which is cured by light irradiation, onto a recording medium placed on a platen; a first irradiator configured to irradiate the ink on the recording medium with light until the ink is cured to a degree of a provisional curing state that the ink is not completely cured; a conveyer configured to convey the recording medium from the platen; and a second irradiator arranged on a downstream side of the first irradiator in a conveying direction of the recording medium by the conveyer, spaced from the first irradiator, and configured to radiate light onto the ink on the recording medium which is made to be in the provisional curing state by the first irradiator with light until the ink in the provisional curing state is cured completely, wherein the first irradiator radiates light with a wavelength of 385 nm, and the second irradiator radiates light with a shorter wavelength than the first irradiator.

According to this configuration, since only internal curing of the ink progresses while image depiction by the head onto the recording medium is being performed on the platen and thus the ink does not completely cure, cockling can be suppressed. Due to this, problems such as the head touching the recording medium due to the cockling and image quality deterioration being caused can be suppressed. Further, surface curing of the ink takes place after the image depiction by the head is completed, and thus the ink is completely cured thereby. Thus, according to the inkjet printing device of an embodiment of the present invention, the generation of the cockling can be suppressed, and printing with superior image quality becomes enabled.

Further, in an inkjet printing device according to an embodiment of the present invention, the second irradiator may radiate light with a wavelength of 365 nm.

Further, in an inkjet printing device according to an embodiment of the present invention, the first irradiator may be an LED light source, and the second irradiator may be a light source other than an LED light source.

According to this configuration, the first irradiator can effectively cause the internal curing of the ink, and the second irradiator can effectively cause the surface curing of the ink.

An inkjet printing method of an embodiment of the present invention includes: a discharging step of discharging ink, which is cured by light irradiation, onto a recording medium placed on a platen; a first irradiation step of irradiating the ink on the recording medium with light with a wavelength of 385 nm radiated by a first irradiator, so as to make the ink be in a degree of a provisional curing state that the ink is not completely cured; a conveying step of conveying the recording medium from the platen after the first irradiation step; and a second irradiation step of irradiating the ink on the recording medium which is made to be in the provisional curing state by the first irradiator with light after the conveying step on a downstream side of the first irradiator in a conveying direction of the recording medium in the conveying step to completely cure the ink in the provisional curing state, wherein in the first irradiation step, light with a longer wavelength than light radiated in the second irradiation step is radiated.

According to the above method, similar effects as those of the inkjet printing device of an embodiment of the present invention can be achieved.

Effect of the Invention

According to an inkjet printing device and an inkjet printing method of an embodiment of the present invention, since only internal curing of the ink progresses while image depiction by the head onto the recording medium is being performed on the platen and thus the ink does not completely cure, cockling can be suppressed. Due to this, problems such as the head touching the recording medium due to the cockling and image quality deterioration being caused can be suppressed. Further, surface curing of the ink takes place after the image depiction by the head is completed, and thus the ink is completely cured thereby. Thus, according to the inkjet printing device and the inkjet printing method of the embodiment of the present invention, generation of the cockling can be suppressed, and printing with superior image quality becomes enabled.

DESCRIPTION OF EMBODIMENT

<Inkjet Printing Device 1>

Figure 1:
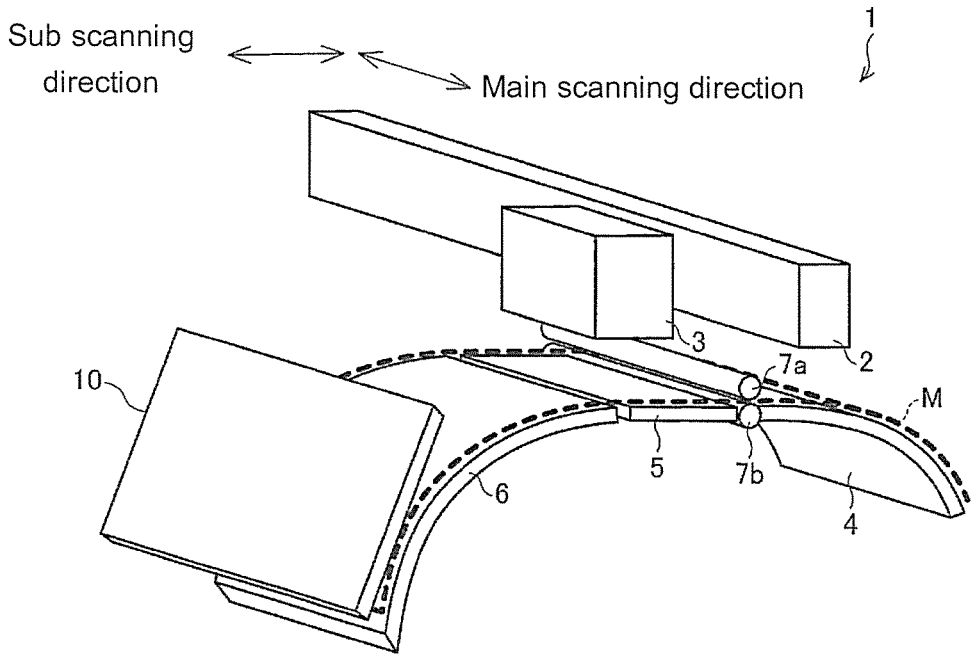
FIG. 1 is a perspective sectional diagram illustrating an internal structure of an inkjet printing device of an embodiment of the present invention.
Figure 2A:
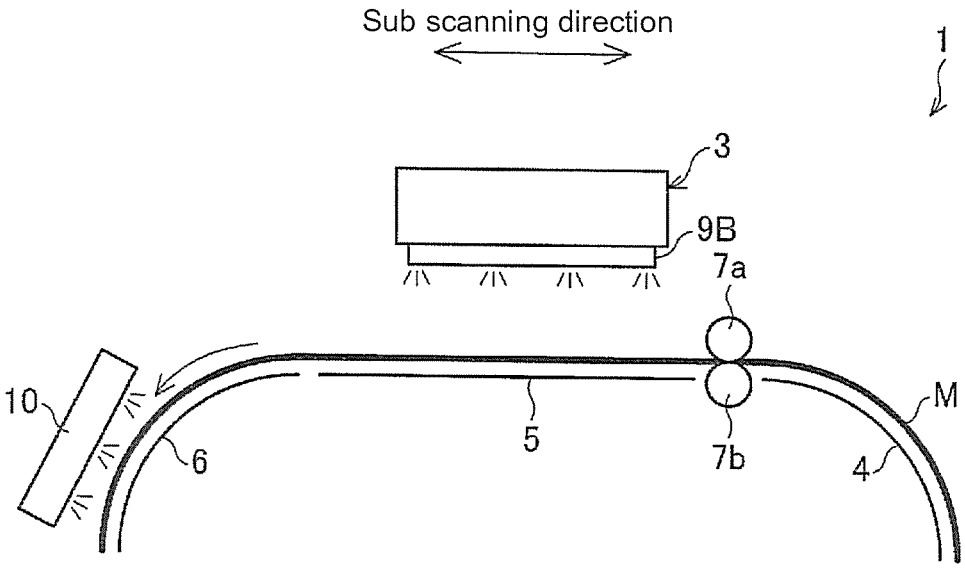
FIG. 2A is a diagram schematically illustrating the internal structure of the inkjet printing device of an embodiment of the present invention.
Figure 2B:
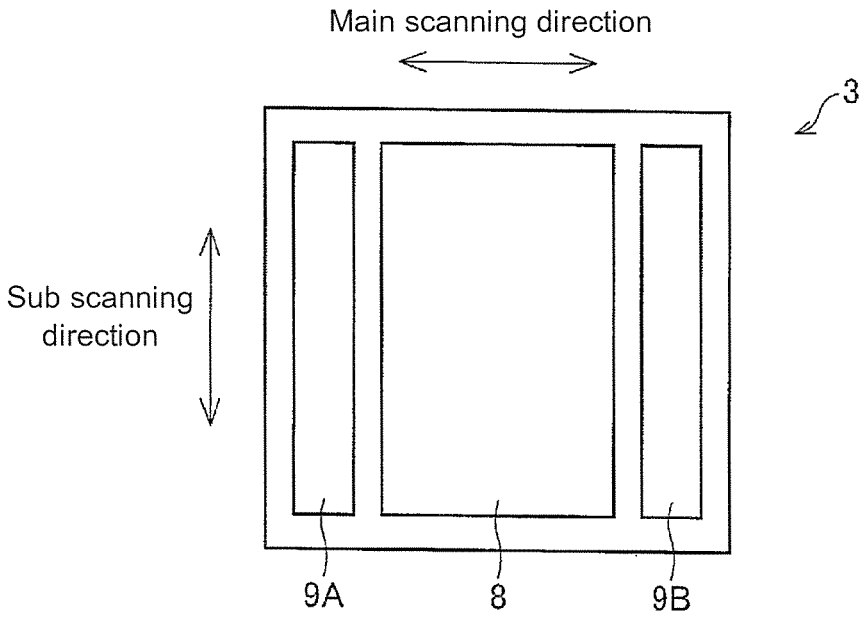
FIG. 2B is a diagram schematically illustrating a structure of a carriage provided in the inkjet printing device of an embodiment of the present invention.

Hereinbelow, an inkjet printing device of an embodiment of the present invention will be described in detail with reference to FIG. 1 and FIGS. 2A and 2B. FIG. 1 is a perspective sectional diagram illustrating an internal structure of an inkjet printing device 1. FIG. 2A is a diagram schematically illustrating the internal structure of the inkjet printing device 1, and FIG. 2B is a diagram schematically illustrating a structure of a carriage 3 provided in the inkjet printing device 1.

As shown in FIG. 1, the inkjet printing device 1 includes a Y bar 2, a carriage 3, a pre-printing platen 4, a printing platen 5 (platen), a post-printing platen 6, a driving roller 7*a* (conveyer), a driven roller 7*b* (conveyer), and a curing irradiation section 10 (second irradiator). The inkjet printing device 1 is configured to perform printing on a medium M (recording medium), and as shown in FIG. 2A, the medium M is placed on the pre-printing platen 4, the printing platen 5, and the post-printing platen 6.

[Y Bar 2]

The Y bar 2 extends along one direction. The direction along which the Y bar 2 extends is a main scanning direction of the inkjet printing device 1. In other words, the main scanning direction is a direction parallel to a surface direction of the printing platen 5. It should be noted that a direction that is another direction parallel to the surface direction of the printing platen 5 and vertical to the main scanning direction is a sub scanning direction. The medium M is conveyed in the sub scanning direction.

[Carriage 3]

As shown in FIG. 2B, the carriage 3 includes a head 8, and pinning irradiation sections 9A, 9B (first irradiator). The carriage 3 is attached to the Y bar 2, and moves in the main scanning direction in a reciprocating manner. Due to this, the carriage 3 moves relative to the printing platen 5, as a result of which the head 8 to be described later moves relative to the printing platen 5. In this embodiment, an embodiment will be described in which the head 8 moves in the main scanning direction and the medium M does not move in the main scanning direction. However, the inkjet printing device according to the present invention is not limited hereto, and it may have a head fixed and a medium may move in the main scanning direction in a reciprocating manner.

[Head 8]

The head 8 discharges ink that is cured by light irradiation onto the medium M. Specifically, the head 8 includes a plurality of nozzles provided thereon, and the ink is discharged from the respective nozzles. As the ink, any ink may be used so long as it can be cured by the light radiated from the pinning irradiation sections 9A, 9B and the curing irradiation section 10, and for example, it is preferable to use ultraviolet light as the light, and use ultraviolet curing ink as the ink. In this embodiment, the explanation will be given for the head 8 that discharges ultraviolet curing ink.

[Platens]

The pre-printing platen 4, the printing platen 5, and the post-printing platen 6 are stations for placing the medium M thereon. The printing platen 5 is arranged at a position facing the carriage 3. The pre-printing platen 4 is arranged on an upstream side of the printing platen 5 in a conveying direction of the medium M (sub scanning direction). Further, the post-printing platen 6 is arranged on a downstream side of the printing platen 5 in the conveying direction of the medium M (sub scanning direction).

[Rollers]

The driving roller 7*a* is for conveying the medium M in the sub scanning direction. The driving roller 7*a* is configured of a roller. Further, the driven roller 7*b* is for assisting the driving roller 7*a* to convey the medium M. The driven roller 7*b* follows rotation of the driving roller 7*a* by driving it, as a result of which the medium M is moved.

[Pinning Irradiation Sections 9A, 9B]

The pinning irradiation sections 9A, 9B are for irradiating the ultraviolet curing ink applied on the medium M by the head 8 with ultraviolet light. Specifically, the pinning irradiation sections 9A, 9B radiate ultraviolet light with a longer wavelength than ultraviolet light radiated from the curing irradiation section 10. For example, the pinning irradiation sections 9A, 9B preferably radiate the ultraviolet light of 385 nm. It should be noted that the pinning irradiation sections 9A, 9B may use various types of light sources so long as they are capable of radiating ultraviolet light with the long wavelength; however, they are preferably LED light sources.

The pinning irradiation sections 9A, 9B are aligned along the main scanning direction, and the head 8 is arranged between the pinning irradiation section 9A and the pinning irradiation section 9B. Due to this, the pinning irradiation sections 9A, 9B move in the same direction as the moving direction of the head 8, that is, in the main scanning direction. That is, when the head 8 moves while applying the ultraviolet curing ink, the applied ultraviolet curing ink is immediately irradiated with the ultraviolet light from the pinning irradiation sections 9A, 9B.

[Curing Irradiation Section 10]

The curing irradiation section 10 is for irradiating, with ultraviolet light, the ultraviolet curing ink which has already been irradiated with the ultraviolet light by the pinning irradiation sections 9A, 9B. Specifically, the curing irradiation section 10 radiates ultraviolet light with a shorter wavelength than the ultraviolet light radiated from the pinning irradiation sections 9A, 9B. For example, the curing irradiation section 10 preferably radiates the ultraviolet light of 365 nm. It should be noted that the curing irradiation section 10 may use various types of light sources so long as they are capable of radiating ultraviolet light with the short wavelength; however, it is preferably a light source other than the LED light source, such as a metal halide lamp or a UV lamp.

The curing irradiation section 10 is arranged at a position facing the post-printing platen 6. That is, the curing irradiation section 10 is arranged on the downstream side of the printing platen 5 in the conveying direction of the medium M (sub scanning direction). The curing irradiation section 10 irradiates, with the ultraviolet light, the medium M on which the image depiction by the head 8 has been finished. The medium M on which the curing of the ultraviolet curing ink is completed is collected by the rotation of the driving roller 7*a* and the driven roller 7*b*.

<Inkjet Printing Method>

Hereinbelow, an inkjet printing method of an embodiment of the present invention will be described in detail.

The printing method of the embodiment includes an ink discharging step of discharging ultraviolet curing ink from the head 8 onto the medium M placed on the printing platen 5, a provisional curing step (first irradiation step) of irradiating the ultraviolet curing ink discharged on the medium M from the head 8 with the ultraviolet light to cure the ultraviolet curing ink to a degree by which it is not completely cured, a conveying step of conveying the medium M from the printing platen 5 after the provisional curing step, and a final curing step (second irradiation step) of irradiating the ultraviolet curing ink on the medium M with the ultraviolet light after the conveying step to completely cure the ultraviolet curing ink.

Specifically, when the medium M is conveyed onto the printing platen 5 by the rotation of the driving roller 7*a* and the driven roller 7*b*, the inkjet printing device 1 moves the carriage 3 along the Y bar 2 in the main scanning direction in a reciprocating manner, discharges the ultraviolet curing ink from the nozzles provided on a lower surface of the head 8, and causes the ultraviolet curing ink to adhere onto the medium M in a desired pattern (ink discharging step).

When this scan is being performed, the pinning irradiation sections 9A, 9B mounted on the carriage 3 are irradiating the ultraviolet light. The ultraviolet light thereof is ultraviolet light with a longer wavelength than the ultraviolet light radiated from the curing irradiation section 10. With the ultraviolet light with long wavelength as radiated from the pinning irradiation sections 9A, 9B, only internal curing of the ultraviolet curing ink takes place, and the ultraviolet curing ink does not completely cure. Due to this, provisional curing (pinning) is performed (provisional curing step). That is, the provisional curing means to irradiate the ultraviolet curing ink on the medium M with ultraviolet light to cure the ultraviolet curing ink to the degree by which it is not completely cured. That is, the ultraviolet curing ink of the provisional curing step is cured such that its hardness is lower than the ultraviolet curing ink after the final curing step. Thus, in the provisional curing step, only the internal curing of the ultraviolet curing ink progresses, and the ultraviolet curing ink does not completely cure; and this leads to suppressing cockling while increasing viscosity of the ultraviolet curing ink, so that the ultraviolet curing ink comes to be in a state of being sufficiently adhered onto the medium M.

After this scan, when a desired image is formed on the medium M, the driving roller 7*a* and the driven roller 7*b* rotate so that the medium M is conveyed from the printing platen 5 (conveying step).

When the medium M is conveyed to the curing irradiation section 10 arranged on the downstream side in the conveying direction, the curing irradiation section 10 irradiates the ultraviolet curing ink on the medium M with the ultraviolet light. The ultraviolet light thereof is ultraviolet light with a shorter wavelength than the ultraviolet light radiated from the pinning irradiation sections 9A, 9B. With the ultraviolet light with short wavelength as radiated from the curing irradiation section 10, surface curing of the ultraviolet curing ink takes place, and the ultraviolet curing ink is completely cured. Due to this, final curing (curing) is performed (final curing step). It should be noted that in this embodiment, final curing means to cure the ultraviolet curing ink on the medium M completely. Further, in the present invention, between the final curing and the provisional curing, curing is performed to a desired hardness in the final curing, and in the provisional curing, curing is performed to a hardness that is less than the desired level.

The above is the inkjet printing method of the inkjet printing device 1 according to the embodiment. In the inkjet printing device 1, only the internal curing of the ultraviolet curing ink progresses by performing the irradiation of the ultraviolet light with long wavelength from the pinning irradiation sections 9A, 9B onto the ultraviolet curing ink on the medium M concurrently with the discharging of the ultraviolet curing ink onto the medium M. Due to this, the viscosity of the ultraviolet curing ink is increased while suppressing the cockling, so that the ultraviolet curing ink comes to be in the state of being sufficiently adhered onto the medium M. Further, after the medium M is conveyed from the printing platen 5, the curing irradiation section 10 located on the downstream side of the conveying direction irradiates the ultraviolet curing ink on the medium M with the ultraviolet light with short wavelength, as a result of which the surface curing progresses to be sufficiently cured while the ultraviolet curing ink maintains strong adherence to the medium M.

As above, only the internal curing of the ultraviolet curing ink progresses while the image depiction by the head 8 onto the medium M is being performed on the printing platen 5, and thus the ink does not completely cure, leading to the suppression of the cockling. Due to this, problems such as the head 8 touching the medium M due to the cockling and image quality deterioration being caused can be suppressed. Further, the surface curing of the ultraviolet curing ink takes place after the image depiction by the head 8 is completed, and thus the ultraviolet curing ink is completely cured thereby. Thus, according to the inkjet printing device 1 of the embodiment, the generation of the cockling can be suppressed, and printing with superior image quality becomes enabled.

The present invention is not limited to the embodiment as mentioned above, and various modifications can be made within the scope described in the claims, and embodiments obtained by suitably combining the technical features disclosed in different embodiments are also encompassed by the technical scope of the present invention.

<Supplemental Description>

The inkjet printing device 1 according to an embodiment of the present invention includes a head 8 configured to discharge the ink, which is cured by light irradiation, onto a recording medium (medium M) placed on a platen (printing platen 5); a first irradiator (pinning irradiation sections 9A, 9B) configured to irradiate the ink on the recording medium with light; a conveyer (driving roller 7*a* and driven roller 7*b*) configured to convey the recording medium from the platen; and a second irradiator (curing irradiation section 10) arranged on a downstream side of the first irradiator in a conveying direction of the recording medium by the conveyer, and configured to irradiate the ink on the recording medium with light, wherein the first irradiator radiates light with a longer wavelength than the second irradiator.

According to this configuration, since only the internal curing of the ink progresses while the image depiction by the head 8 onto the recording medium is being performed on the platen and thus the ink does not completely cure, cockling can be suppressed. Due to this, problems such as the head touching the recording medium and image quality deterioration being caused can be suppressed. Further, surface curing of the ink takes place after the image depiction by the head 8 is completed, and the ink is completely cured thereby. Thus, according to the inkjet printing device 1 of the embodiment of the present invention, the generation of the cockling can be suppressed, and printing with superior image quality becomes enabled.

Further, in the inkjet printing device 1 according to an embodiment of the present invention, the first irradiator may radiate light with a wavelength of 385 nm, and the second irradiator may radiate light with a wavelength of 365 nm.

Further, in the inkjet printing device 1 according to an embodiment of the present invention, the first irradiator may be an LED light source, and the second irradiator may be a light source other than an LED light source.

According to this configuration, the first irradiator can effectively cause the internal curing of the ink, and the second irradiator can effectively cause the surface curing of the ink.

An inkjet printing method of an embodiment of the present invention includes: an ink discharging step of discharging the ink, which is cured by light irradiation, onto a recording medium (medium M) placed on a platen (printing platen 5); a first irradiation step of irradiating the ink on the recording medium with light; a conveying step of conveying the recording medium from the platen after the first irradiation step; and a second irradiation step of irradiating the ink on the recording medium with light after the conveying step on a downstream side of a first irradiator in a conveying direction of the recording medium in the conveying step, wherein in the first irradiation step, light with a longer wavelength than light radiated in the second irradiation step is radiated.

According to the above method, similar effects as those of the inkjet printing device 1 of an embodiment of the present invention can be achieved.

INDUSTRIAL APPLICABILITY

The present invention can be utilized in inkjet printing devices.

The invention claimed is:

1. An inkjet printing device configured to perform printing by discharging ink, the inkjet printing device comprising:

a head, configured to discharge the ink, which is cured by light irradiation, onto a recording medium placed on a platen;

a first irradiator, configured to irradiate the ink on the recording medium with light until the ink is cured to a degree of a provisional curing state that the ink is not completely cured;

a conveyer, configured to convey the recording medium from a position opposite to the first irradiator; and a second irradiator, arranged on a downstream side of the first irradiator in a conveying direction of the recording medium by the conveyer, spaced from the first irradiator, and configured to irradiate the ink on the recording medium which is made to be in the provisional curing state by the first irradiator with light until the ink in the provisional curing state is cured completely, wherein the first irradiator radiates light with a wavelength of 385 nm to the ink which is discharged onto the recording medium to a degree that the ink is sufficiently adhered to the recording medium, and the second irradiator radiates light with a shorter wavelength than the first irradiator to the ink in the provisional curing state on the recording medium.

2. The inkjet printing device according to claim 1, wherein the second irradiator radiates light with a wavelength of 365 nm.

3. The inkjet printing device according to claim 1, wherein the first irradiator is an LED light source, and the second irradiator is a light source other than an LED light source.

4. An inkjet printing method for performing printing by discharging ink, the inkjet printing method comprising:

an ink discharging step of discharging the ink, which is cured by light irradiation, onto a recording medium placed on a platen;

a first irradiation step of irradiating the ink discharged onto the recording medium with light with a wavelength of 385 nm radiated by a first irradiator to a degree that the ink is sufficiently adhered to the recording medium, so as to make the ink be in a degree of a provisional curing state that the ink is not completely cured;

a conveying step of conveying the recording medium from a position opposite to the first irradiator after the first irradiation step; and a second irradiation step of irradiating the ink discharged onto the recording medium which is made to be in the provisional curing state by the first irradiator with light after the conveying step on a downstream side of the first irradiator in a conveying direction of the recording medium in the conveying step to completely cure the ink in the provisional curing state, wherein in the first irradiation step, light with a longer wavelength than light radiated in the second irradiation step is radiated.

5. The inkjet printing device according to claim 2, wherein the first irradiator is an LED light source, and the second irradiator is a light source other than an LED light source.

6. An inkjet printing device configured to perform printing by discharging ink, the inkjet printing device comprising:

a head, configured to discharge the ink, which is cured by light irradiation, onto a recording medium placed on a platen;

a first irradiator, configured to irradiate the ink on the recording medium with light until the ink is cured to a degree of a provisional curing state that the ink is not completely cured;

a conveyer, configured to convey the recording medium from a position opposite to the first irradiator; and a second irradiator, arranged on a downstream side of the first irradiator in a conveying direction of the recording medium by the conveyer, spaced from the first irradiator, and configured to irradiate the ink on the recording medium which is made to be in the provisional curing state by the first irradiator with light until the ink in the provisional curing state is cured completely, wherein the first irradiator radiates light with a wavelength of 385 nm to the ink which is discharged onto the recording medium to a degree that the ink is sufficiently adhered to the recording medium and a generation of cockling of the recording medium is prevented, and the second irradiator radiates light with a shorter wavelength than the first irradiator to the ink in the provisional curing state on the recording medium.

7. The inkjet printing device according to claim 6, wherein the second irradiator radiates light with a wavelength of 365 nm.

8. The inkjet printing device according to claim 6, wherein the first irradiator is an LED light source, and the second irradiator is a light source other than an LED light source.

* * * * *